US007621417B2

(12) United States Patent
Peterson et al.

(10) Patent No.: US 7,621,417 B2
(45) Date of Patent: Nov. 24, 2009

(54) CONTAINER WITH INTEGRAL FOAM GASKET

(75) Inventors: Robert J. Peterson, Medina, OH (US); Leighann Sturgin, Shreve, OH (US); Amanda K. Plakosh-Angeles, Lexington, KY (US)

(73) Assignee: Rubbermaid Incorporated, Huntersville, NC (US)

( * ) Notice: Subject to any disclaimer, the term of this patent is extended or adjusted under 35 U.S.C. 154(b) by 606 days.

(21) Appl. No.: 10/964,261

(22) Filed: Oct. 13, 2004

(65) Prior Publication Data

US 2006/0076352 A1 Apr. 13, 2006

(51) Int. Cl.
*B65D 51/18* (2006.01)
*B65D 53/00* (2006.01)
*B28B 5/00* (2006.01)

(52) U.S. Cl. ..... 220/254.3; 220/378; 220/835; 264/250

(58) Field of Classification Search ..... 220/254.3, 220/835, 840, 833, 825, 254.7, 378, 315, 220/592.01, 319, 795, 780, 796, 806, 646, 220/655, 658, 642, 254.1; 62/457.1, 457.7
See application file for complete search history.

(56) References Cited

U.S. PATENT DOCUMENTS

| | | | | | |
|---|---|---|---|---|---|
| 3,618,814 | A * | 11/1971 | Nagroski | 220/804 |
| 5,139,715 | A * | 8/1992 | Katsuno et al. | 264/46.4 |
| 5,509,565 | A * | 4/1996 | Hoffman | 220/378 |
| 5,582,314 | A * | 12/1996 | Quinn et al. | 220/326 |
| 6,202,887 | B1 * | 3/2001 | Petit | 220/849 |
| 6,772,904 | B1 * | 8/2004 | Gilliam et al. | 220/836 |
| 2003/0136783 | A1 * | 7/2003 | Hatsumoto et al. | 220/254.3 |
| 2004/0118848 | A1 * | 6/2004 | Marshall | 220/266 |

* cited by examiner

*Primary Examiner*—Robin Hylton
(74) *Attorney, Agent, or Firm*—Dennis J. Williamson; Moore & Van Allen, PLLC

(57) ABSTRACT

A container having an openable lid includes a body and a lid. The body includes a base, at least one wall extending upwardly from the base, and a first surface disposed near a top of the at least one wall. The lid is adapted to engage a top of the at least one wall when the container is in a closed position, and includes a second surface disposed near a bottom of the lid. A foam gasket is permanently attached to and located on one of the first and second surfaces, and provides a seal between the lid and the body when the container is in a closed position. The gasket is attached to the surface while in fluid form.

11 Claims, 11 Drawing Sheets

CONTAINER WITH INTEGRAL FOAM GASKET

FIELD OF THE INVENTION

The present invention generally relates to sealed storage containers and, more particularly, to a sealed container having a foam-in-place gasket.

BACKGROUND OF THE DISCLOSURE

Containers having openable lids are generally known in the art and have numerous uses and features. Containers having openable lids are used as wastepaper baskets, garbage cans, coolers, storage bins, and the like. Some of these types of containers may also have additional features, such as hinged lids, lids having seals, insulation, and/or the like.

For example, coolers come in many shapes and sizes but usually include a body having four insulated sides and an insulated lid. More specifically, the upper portion of the body includes a lip or ridge that corresponds to a channel located on the underside of the lid. The channel and ridge create a seal between the lid and the body to keep cool air in the cooler and to keep heat and debris out. This type of cooler has several disadvantages. For example, the food stored in the cooler may remain cold for a limited period of time, but the cooler is not designed to prevent the food from becoming stale if stored for an extended period of time. Other types of coolers have a separate seal adhered to the body or lid, similar to the pet food container described below.

Pet food containers known in the art can include a container body having four sides and a lid that is pivotally attached to the body. The pet food containers may further include a locking mechanism for securing the lid to the body in a closed position, and a rubber seal located between the lid and the body to prevent the dog food, for example, from becoming stale. More specifically, the rubber seal is a separate piece from both the body and lid and rests in a groove located on the top of the body. When the pet food container is in a closed position, a second groove located on the underside of the lid bears against the rubber seal, compressing the seal between the lid and the body. This type of pet food container also has several disadvantages. There is an increased cost involved in manufacturing and having a separate rubber seal. The extra cost is not only created by the cost of purchasing or manufacturing such a rubber seal, but also comes from the expenditure of time and money involved in storing, tracking, and installing such a seal.

SUMMARY OF THE DISCLOSURE

In accordance with one aspect of the disclosure, among others, a container having an openable lid is disclosed. The container includes a body, a lid, and a foam gasket. The body includes a base and at least one wall extending upwardly from the base. A first surface is disposed near a top of the at least one wall, and the lid is adapted to engage a top of the at least one wall, when the container is in a closed position. A second surface is disposed near a bottom of the lid. The foam gasket is permanently attached to and located on one of the first and second surfaces, and provides a seal between the lid and the body when the container is in a closed position. The gasket is attached to the surface while in fluid form.

In accordance with another one aspect of the disclosure, a container having an openable lid and an intermediate section is disclosed. The container includes a body, an intermediate section, a first foam gasket, a lid, and a second foam gasket. The body includes a base having at least one wall extending upwardly therefrom, and a first surface disposed near a top of the at least one wall. The intermediate section is removably attached near the top of the at least one wall, and includes a second surface disposed near a bottom of the intermediate section, and a third surface disposed near a top of the intermediate section. The lid is adapted to engage the top of the intermediate section, and includes a fourth surface disposed near a bottom of the lid. A first foam gasket is permanently attached to and located on one of the first and second surfaces, and a second foam gasket is permanently attached to and located on one of the third and fourth surfaces. The first gasket provides a seal between the body and the intermediate section and the second gasket provides a seal between the intermediate section and the lid when the container is in a closed position. The gaskets are attached to the surfaces while in fluid form.

Figure 1:
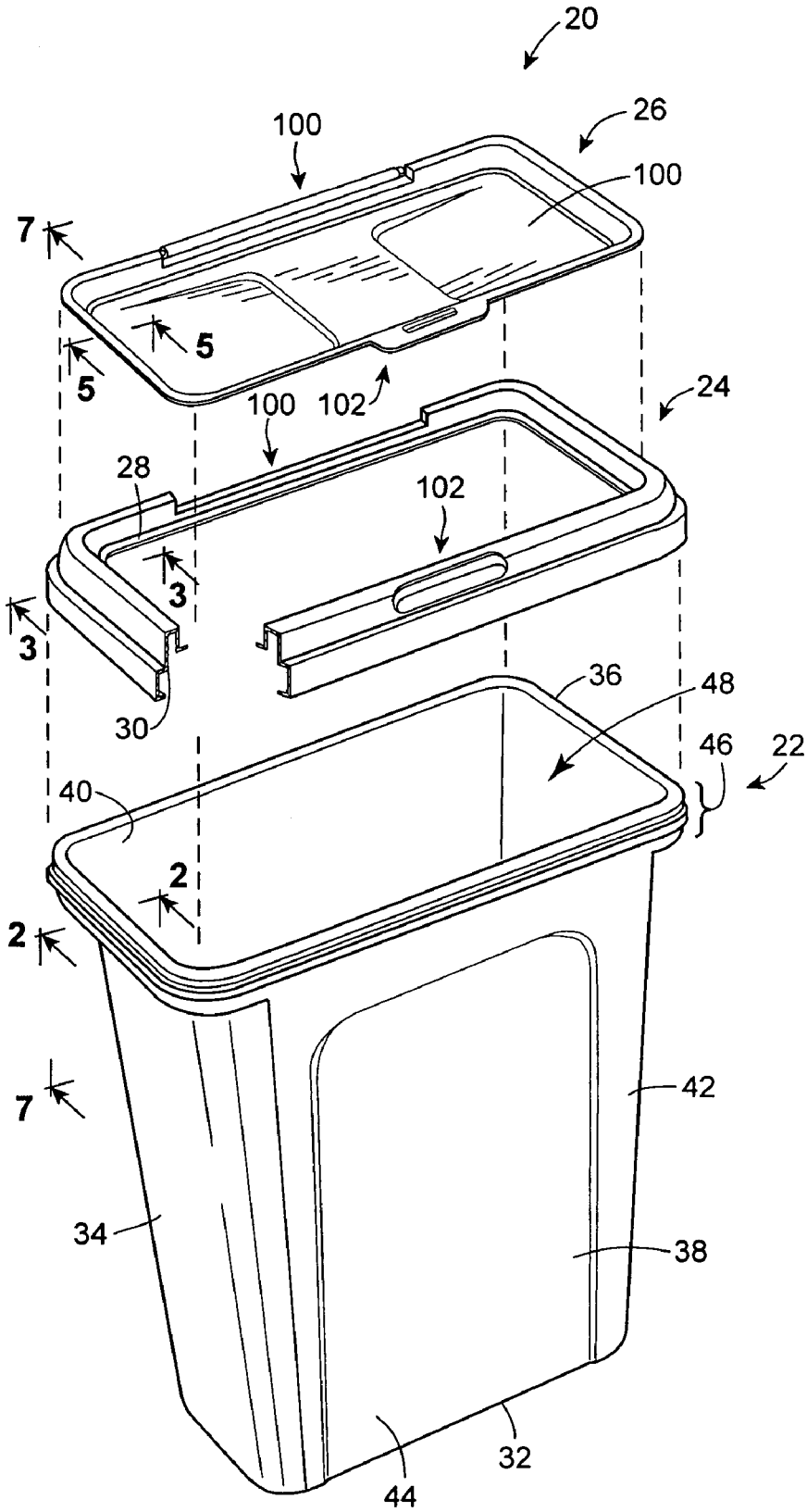
FIG. 1 is an exploded perspective view of one embodiment of a container in accordance with the teachings of the present disclosure.

While the method and device described herein are susceptible to various modifications and alternative constructions, certain illustrative embodiments thereof are shown in the drawings and are described below in detail. It should be understood, however, that there is no intention to limit the invention to the specific forms disclosed, but on the contrary, the intention is to cover all modifications, alternative constructions, and equivalents falling within the spirit and scope of the invention and the appended claims.

DETAILED DESCRIPTION

Referring now to the drawings, and with specific reference to FIG. 1, a container constructed in accordance with the teachings of the disclosure is generally depicted by reference numeral 20. As shown therein, the container 20 includes a body 22, a seal ring 24, a lid 26, and first and second gaskets 28, 30.

The container 20 in this example can be used to store dry goods, including, but not limited to, food, pet food, or any other object that would benefit from being in a container having a tight seal. For the sake of clarity and brevity, however, the container 20 will herein be described as being used as a pet food storage container.

The container 20 parts including the body 22, the seal ring 24, and the lid 26 may be fabricated from relatively light weight, durable, and sturdy plastic materials such as polyethylene, polypropylene, polystyrene, or other suitable plastic materials. Similarly, the color of the materials can vary such that the appearance of the container 20 may vary, or the container 20 may be clear. The container 20 can also be injection molded, blow molded, continuously molded, extruded, vacuum formed, or the like. The manufacturing process or processes and materials of the body 22, the seal ring 24, and the lid 26 can be selected based on feasibility, cost, and tooling concerns, as well as other factors for a given application.

In one exemplary embodiment, the body 22 of the container 20 includes a substantially rectangular base or bottom wall 32. The body 22 has a first side wall 34, a second side wall 36, a front wall 38, and a rear wall 40 that together define a contiguous side wall 42, having a lower end 44, extending upward from a perimeter of the bottom wall or base 32. The side wall 42 terminates at a rim 46 at a top of the body 22. The base 32 is generally planar thereby giving the body 22, and hence the container 20, a stable footing. The walls 34-40 and base 32 in combination define an interior 48 for storing the food. The rim 46 is disposed on an upper end of the side wall 42 and, in this example, is configured for engaging with the seal ring 24.

Figure 2:
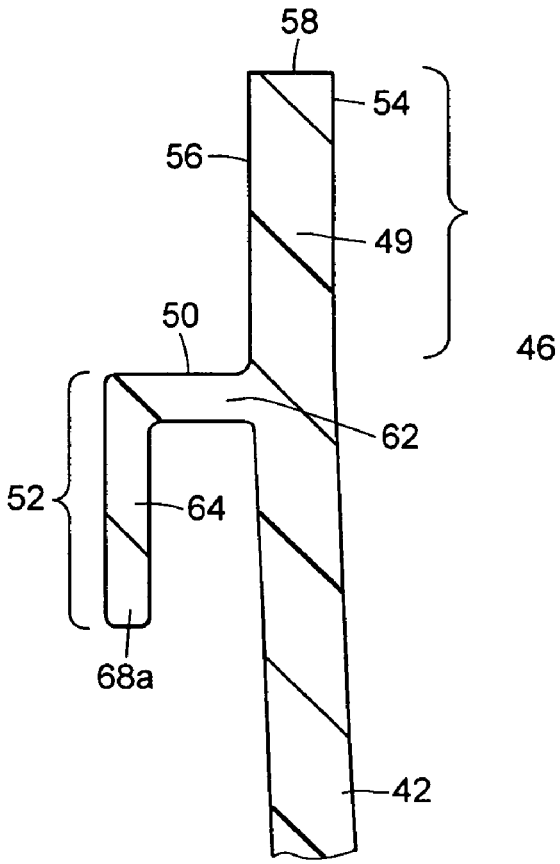
FIG. 2 is a cross-sectional view of the container of FIG. 1, taken along line 2-2 of FIG. 1.

The rim 46, as illustrated in FIGS. 1 and 2, also has a generally rectangular shape, and defines an opening to the interior 48 of the body 22. The rim 46, as seen in FIG. 2, includes an upwardly extending guide ridge 49 and a body flange 52. The guide ridge 49 is disposed near a top of the rim 46 and includes an inner surface 54, an outer surface 56, and a top surface 58 that in combination receive and locate the seal ring 24. More specifically, the top surface 58, in this example, is a flat surface that is disposed on a top of the guide ridge 49 and is oriented generally parallel to the base 32. The inner surface 54 of the guide ridge 49 is disposed to the inside of the container 20, the outer surface 56 is disposed to the outside of the container 20, and both of the surfaces 54 and 56 extend downwardly from the top surface 58 of the guide ridge 49.

An upper portion 62 of the body flange 52 depends from the outer surface 56 of the guide ridge 49 and extends axially outward therefrom. A body seal surface 50 is disposed to a top of the upper portion 62 and, as such, is oriented generally parallel to the base 32. A side portion 64 of the body flange 52 depends from the upper portion 62 of the body flange 52 and extends in a general downwardly direction. A bottom end of the side portion 64 of the body flange 52 may be generally rigid and may form a first part 68*a* of a locking mechanism 68, which will be described in more detail below.

Figure 3:
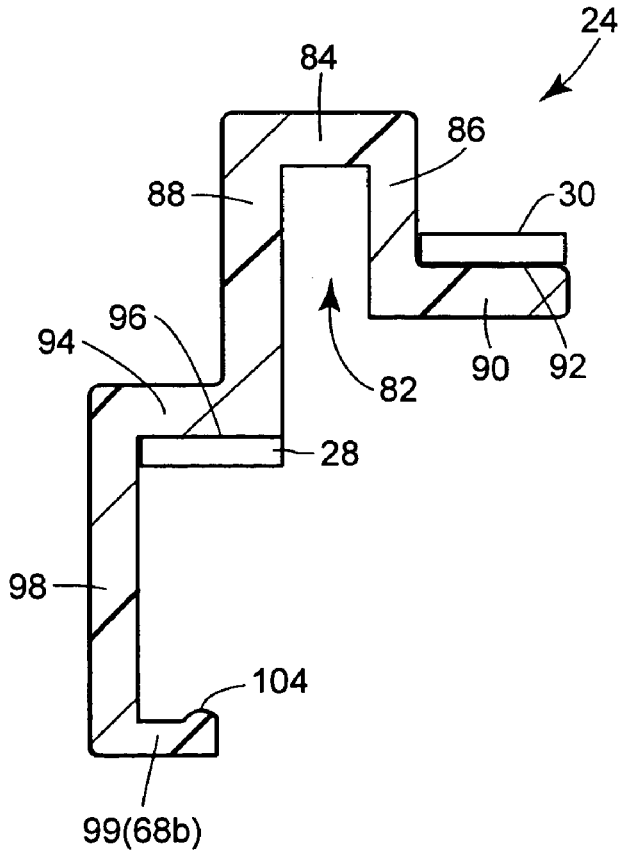
FIG. 3 is a cross-sectional view of the container of FIG. 1, taken along line 3-3 of FIG. 1.
Figure 4:
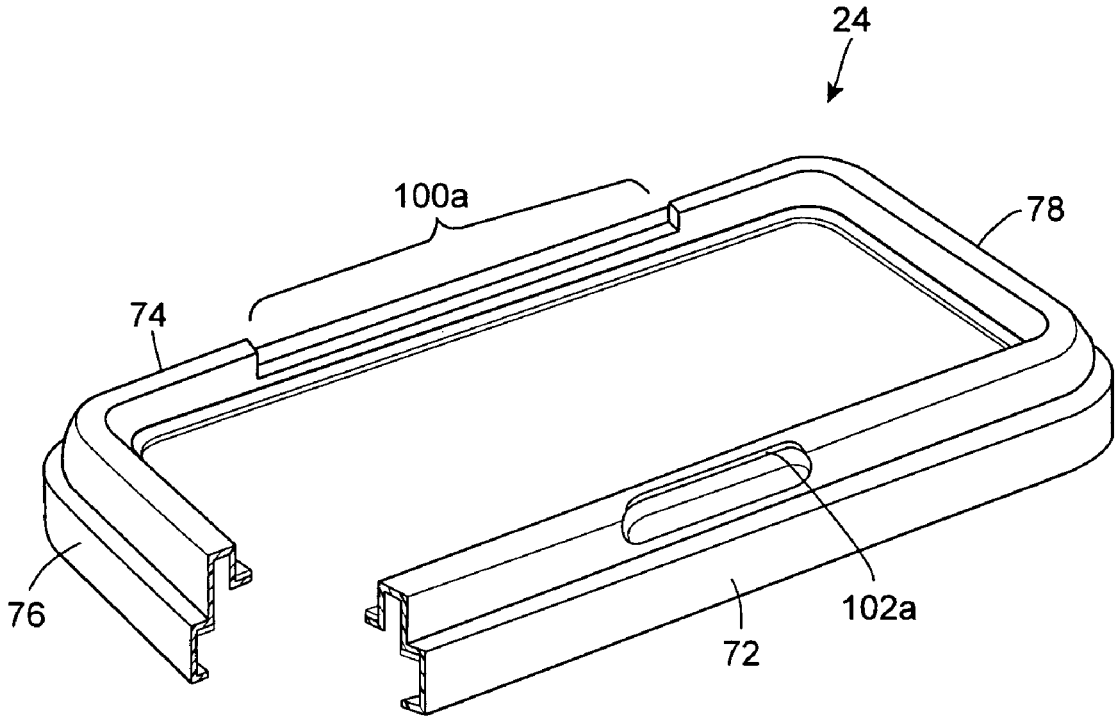
FIG. 4 is an enlarged isometric and partial cut-away view of a seal ring of the container of FIG. 1.

In one exemplary embodiment, as illustrated in FIGS. 1 and 4, the seal ring 24 of the container 20 is intermediate the body 22 and the lid 26. The seal ring 24, in this exemplary embodiment, has a front portion 72, a rear portion 74, a first side portion 76, and a second side portion 78, that in combination create a corresponding shape to the base 32 and the rim 46, which in this exemplary embodiment, is generally rectangular. The seal ring 24, as seen in FIG. 3, includes the ridge groove 82 that is defined by a top wall 84 and spaced apart inner and outer walls 86 and 88, respectively. The guide ridge 49 is received in the ridge groove 82 when the seal ring 24 is installed. An upper seal flange 90 extends outwardly from a bottom of the inner wall 86, and includes an upper seal ring surface 92 disposed on a top of the upper seal flange 90. As such, the upper seal ring surface 92 is substantially parallel to the base 32 and faces upwardly. A lower seal flange 94 extends outwardly from a bottom of the outer wall 88, and includes a lower seal ring surface 96 disposed on a bottom of the lower seal flange 94. As such, lower seal ring surface 96 is substantially parallel to the base 32 and faces downwardly. A seal ring skirt 98 extends downwardly from the lower seal flange 94 and, as such, is substantially perpendicular to the base 32. A locking flange 99 may extend inwardly from a bottom of the seal ring skirt 98, and may form a second part 68*b* of the locking mechanism 68. The second part 68*b* of the locking mechanism 68 may also include or be a clip, ridge, or other portion able to engage and secure to the first part 68*a* of the locking mechanism 68. For example, as seen in FIG. 3, the second part 68*a* of the sealing mechanism 68 may also include a protrusion or bump 104, and may be adapted to abut and engage the bottom end of the side portion 64 of the body flange 52 (FIG. 2), when the seal ring 24 is attached to the body 22.

Figure 5:
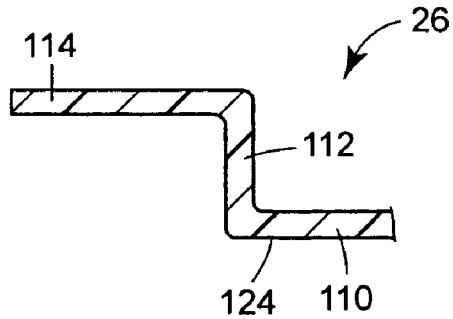
FIG. 5 is a cross-sectional view of the container of FIG. 1, taken along line 5-5 of FIG. 1.
Figure 6:
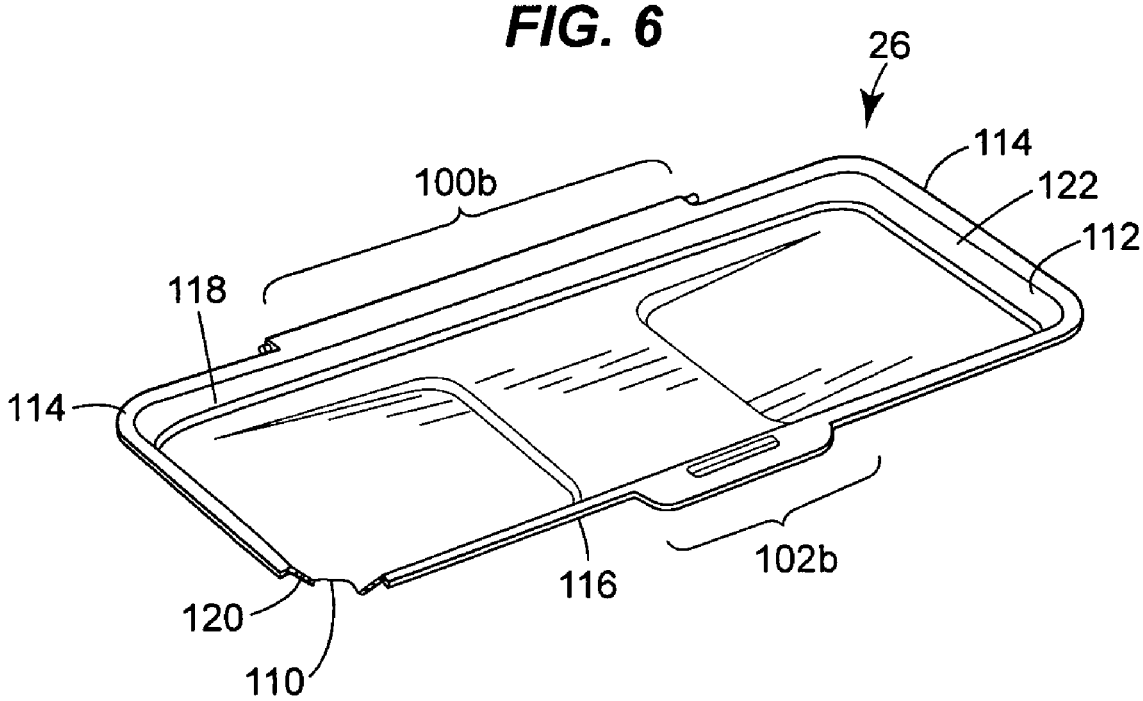
FIG. 6 is an enlarged isometric and partial cut-away view of a lid of the container of FIG. 1.

In one exemplary embodiment, as illustrated in FIGS. 1, 5, and 6, the lid 26 of the container 20 is disposed on the seal ring 24, and includes a lower wall 110, a side wall 112, and a lid flange 114. The lower wall 110, in this exemplary embodiment, engages the seal ring 24, and may be rectangular. The side wall 112, as seen in FIG. 6, may include a front side 116, a rear side 118, a first side 120, and a second side 122, which in combination may connect the lower wall 110 to the lid flange 114. The lid flange 114 may extend outwardly from an upper end of the side wall 112, and may define a circumference of the lid 26.

A lid seal surface 124 (FIG. 5) may be disposed near a circumference of a bottom surface of the lower wall 110, and may be adapted to engage the second gasket 30 and/or the upper seal ring seal surface 92 (FIGS. 5 and 6). The lower wall 110 and the side wall 112 may be sized and shaped, such that the lid seal surface 124 substantially engages an entire top surface of the second gasket 30, and such that the side wall 112 of the lid 26 is substantially parallel and adjacent to the inner wall 86 of the seal ring 24, when the container 20 is in a closed position. Similarly, a lower surface of the lid flange 114 may be parallel and adjacent to the top wall 84 of the seal ring 24.

Figure 7:
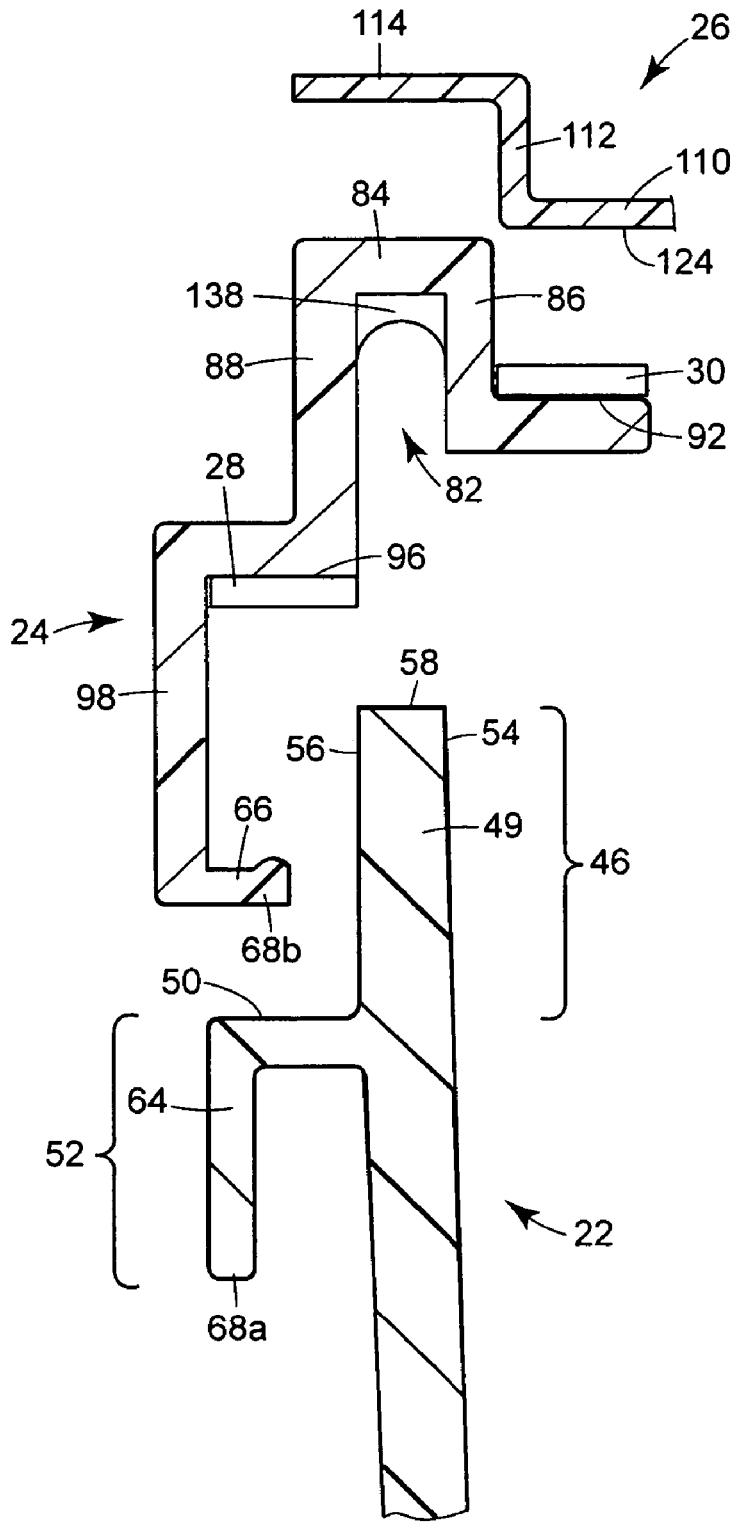
FIG. 7 is a cross-sectional view of the container of FIG. 1, taken along line 7-7 of FIG. 1.

In one exemplary embodiment, as seen in FIGS. 3 and 7, the first gasket 28 abuts the body seal surface 50 of the body 22, when the body 22 and the seal ring 24 are engaged. More specifically the first gasket 28 is a foam-in-place gasket 28 that can be placed on the lower seal ring surface 96 in semi-liquid to liquid form during manufacture and is then dried through a curing process. The first gasket 28 may be constructed from a foam material, but may be constructed from any type of gasket material. The first gasket 28 may have a generally rectangular cross-section and may be a contiguous gasket 28 disposed along the entire circumference of the lower seal ring surface 96. The first gasket 28 may be attached to the lower seal ring surface 96 in many ways, such as by the naturally adhesive properties of the gasket material, or chemical bonding between the gasket and body materials. In this embodiment, however, the first gasket 28 may inherently adhere to the lower seal ring surface 96 as the gasket 28 changes from a liquid to a solid state. Once in the solid state, even though the gasket 28 remains adhered to the lower seal ring surface 96, the gasket 28 may not be sticky to the touch.

Furthermore, the first gasket 28 may be constructed and/or installed using a material and/or process that has been approved by the Federal Food and Drug Administration ("FDA"), such that the first gasket 28 may be utilized, as in this exemplary embodiment, with food and/or drug related containers.

Similarly, the second gasket 30 is fixedly attached to and disposed on the upper seal ring surface 92, such that the second gasket 30 is disposed between the upper seal ring surface 92 and the lid seal surface 124 of the lid 26, when the container 20 is in a closed position. The second gasket 30 may have all the attributes and qualities of the first gasket 28 and may, therefore, be identical to or least substantially similar to the first gasket 28 in construction and material.

Figure 8:
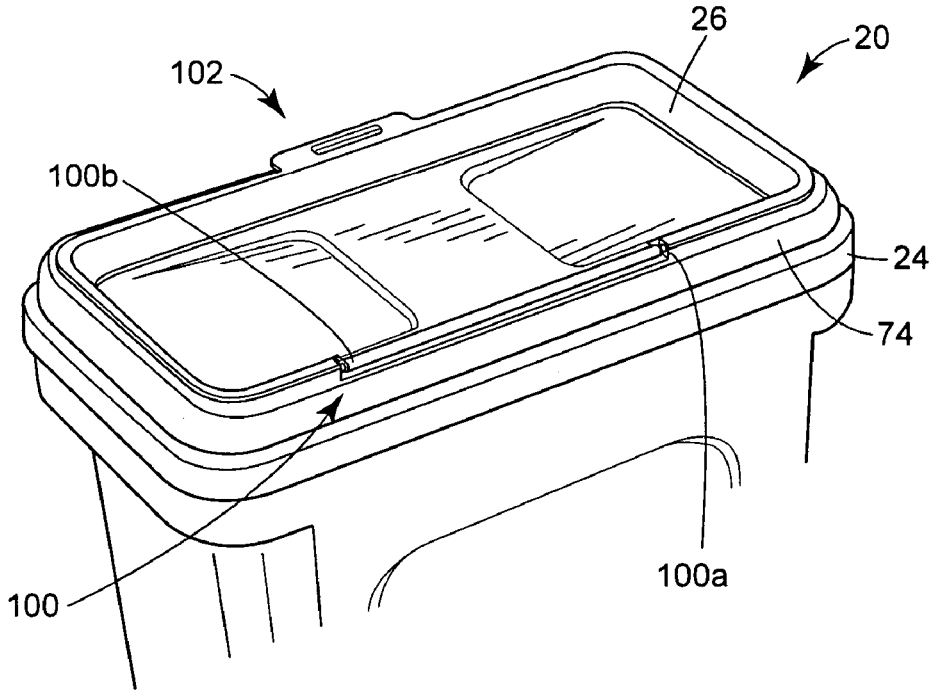
FIG. 8 is an enlarged rear isometric view of the container of FIG. 1.
Figure 9:
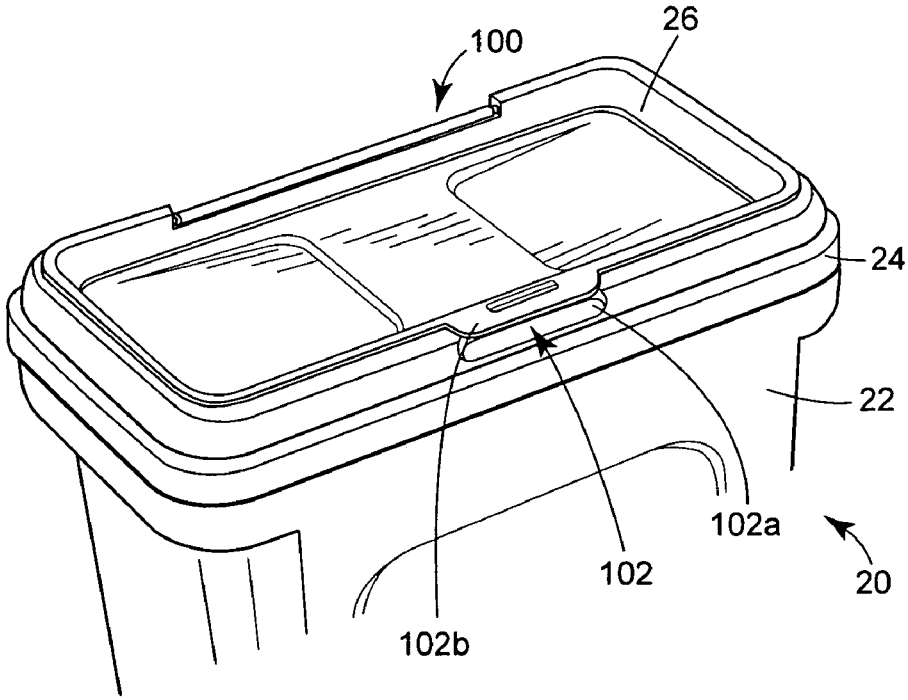
FIG. 9 is an enlarged front isometric view of the container of FIG. 1.

In one embodiment, as seen in FIGS. 1, 8, and 9, the container 20 includes a pivot mechanism 100 and a latching mechanism 102. A first pivot portion 100*a* of the pivot mechanism 100 is disposed near the rear portion 74 of the seal ring 24 and may, as in this exemplary embodiment, include a cut-up portion having a pair of apertures adapted to receive a second pivot portion 100*b* (FIG. 8), or may be constructed in any conventional manner. The second pivot portion 100*b* may be disposed on the lid 26 and may include an elongate extension having a pair of posts adapted to engage the cut-up portion and the pair of apertures. A first latching portion 102*a* of the latching mechanism 102 may be disposed near a front portion of the seal ring 24 and may, as in this exemplary embodiment, include a detent portion and a tab adapted to receive a second latching portion 102*b* (FIG. 9), or may be constructed in any conventional manner. The second latching portion 102*b* may be disposed on the lid 26 and may include a handle and a slot adapted to engage the detent portion and the tab.

The above exemplary embodiment may include many variations thereof, to achieve and/or create additional and/or alternative embodiments. For example, the container 20 need not be rectangular in shape, but may be any shape desirable, including, but not limited to, circular, oval, square, triangular, etc. Accordingly, the various part of the container 20, such as the body 22, the seal ring 24, and the lid 26 may similarly vary in shape.

Figure 9A:
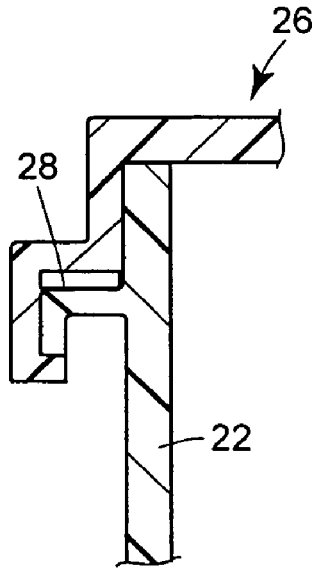
FIG. 9*a* is a cross-sectional view of another example of a container having a single foam gasket and no seal ring.

The various parts of the container 20 may also be integral with each other, or may be eliminated entirely. For example, the seal ring 24 and the body 22 may actually be one integral piece thereby eliminating the need for the first gasket 28. Similarly, the lid 26 and the seal ring 24 may be one integral piece thereby eliminating the need for the second gasket 30. For example, as illustrated in FIG. 9*a*, the container 20 may only include the first gasket 28. Furthermore, the gaskets 28, 30 need not be attached to the upper and lower seal ring surfaces 92, 96, but may be attached to the body seal surface 50 and/or the lid seal surface 124, respectively.

Figure 10:
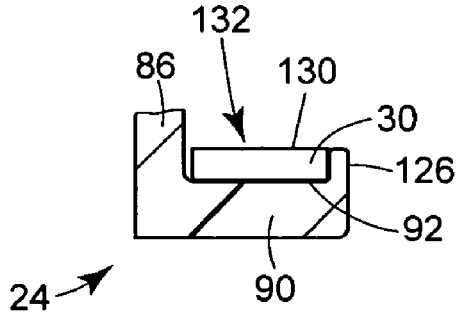
FIG. 10 is an enlarged cross-sectional view of a first foam gasket.
Figure 11:
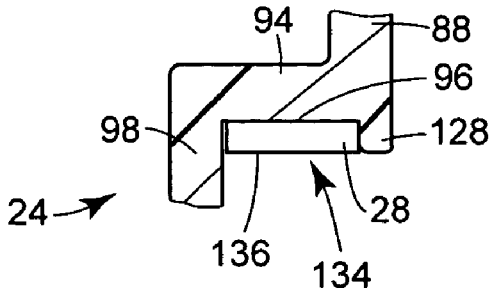
FIG. 11 is an enlarged cross-sectional view of a second foam gasket.

The container 20, and more specifically, the upper seal ring surface 92 and/or the lower seal ring surface 96 may also include an upper retaining ridge 126 and a lower retaining ridge 128, respectively (FIGS. 10 and 11). For example, as seen in FIG. 10, the upper retaining ridge 126 may be disposed near an outer end of the upper seal flange 90 of the seal ring 24, and may extend upwardly therefrom. As such, a valley 132 defined by the upper retaining ridge 126, the upper seal flange 90, and the inner wall 86 may be created to retain and/or nestle the second gasket 30. The upper retaining ridge 126 may be limited in height, such that an upper end of the upper retaining ridge 126 is positioned between a mating surface 130 of the second gasket 30 and the upper seal ring surface 92, when the container 20 is in a closed position and the second gasket 30 is in a state of compression between the seal ring 24 and the lid 26. As such, the lid 26 is prevented from abutting the upper retaining ridge 126, thereby allowing for the tight seal between the second gasket 30 and the lid 26. Similarly, as seen in FIG. 11, the lower retaining ridge 128 may be disposed near a lower end of the outer wall 88 of the seal ring 24, and may extend downwardly therefrom. As such, a valley 134 defined by the lower retaining ridge 128, the lower seal flange 94, and the seal ring skirt 98 may be created to retain and/or nestle the first gasket 28. The lower retaining ridge 128 may be limited in height, such that a lower end of the lower retaining ridge 128 is positioned between a mating surface 136 of the first gasket 28 and the lower seal ring surface 96, when the seal ring 24 is locked onto the body 22 and the first gasket 28 is in a state of compression between the seal ring 24 and the body 22. As such, the body 22 is prevented from abutting the lower end of the lower retaining ridge 128, thereby allowing for the tight seal between the first gasket 28 and the body 22.

Structural and esthetic details may also be included in the container 20, and may alter the manner in which the components of the container 20 combine. For example, as seen in FIG. 7 the ridge groove 82 may include a plurality of ribs 138 extending across at least part of the vertical cross-section of the ridge groove 82. As such, one or more portions of the guide ridge 49 may, during engagement with the ridge groove 82, abut the ribs 138 along with and/or instead of a bottom surface of the top wall 84 of the seal ring 24.

The locking mechanism 68 and/or the latching mechanism 102 may also vary in technology and structure. For example, the locking mechanism 68 and latching mechanisms 102 may be any type of mechanism able to accomplish their intended purpose. The mechanisms 68, 102 may include additional objects, such as screws, clips, and resilient members, and/or may have alternate structures.

In operation, the container 20 may be utilized to store any number of objects that may benefit from a sealed container 20. For example, in this exemplary embodiment, the container 20 will be described as storing dog food. The container 20 may be positioned on a substantially planar surface, such that the base 32 of the body 22 abuts and is substantially parallel to the floor. The lower end 44 of the side wall 42 of the body 22 is disposed from the base 32 and extends upwardly therefrom, having at the upper end of the side wall 42, the rim 46.

Prior to and or after the body 22, the seal ring 24, and/or the lid 26 are connected, the first and second gaskets 28, 30 may be placed on the seal ring 24. For example, a nozzle from an automated machine may dispense the foam gasket in liquid form onto the various portion of the container 20 and, in this exemplary embodiment, may dispend the liquid onto the onto the upper seal ring surface 92 and the lower seal ring surface 96. The upper and lower seal ring surfaces 92, 96 may be pre-treated prior to receiving the liquid foam. The pre-treatment may include, but is not limited to, cleaning, priming or roughing the upper and lower seal ring surfaces 92, 96. If the seal ring 24 includes the upper and lower retaining ridges 126, 128, the ridges 126, 128 may be used to locate the first and second gaskets 28, 30 during installation and/or operation. For example, as the first and second gaskets 28, 30 are poured onto the lower seal and upper seal ring surfaces 96, 92 during installation, the lower and upper retaining ridges 128, 126 may provide a barrier for the gaskets 28, 30 when in liquid form. Additionally and/or alternatively, the lower and upper retaining ridges 128, 126 may aid the gaskets 28, 30 in retaining their shape.

As best seen in FIGS. 1 and 7, the seal ring 24 is placed on the body 22 and, more specifically, the seal ring 24 is placed on the rim 46 by guiding the ridge groove 82 of the seal ring 24 onto the guide ridge 49 of the rim 46. The ridge groove 82, and hence the seal ring 24, may be placed onto the guide ridge 49 such that the inner surface 54, the outer surface 56, and the top surface 58 of the guide ridge 49, substantially abut and align with the inner wall 86, the outer wall 88, and the top wall 84 of the ridge groove 82, respectively. As such, the body seal surface 50 and the lower seal ring surface 96 will be aligned and be parallel to each other, and the seal ring skirt 98 of the seal ring 24 will substantially abut and be parallel to the flange side portion 64 of the body flange 52. An tight seal is created between the seal ring 24 and the body 22 by compressing and securing the first gasket 28 between the body seal surface 50 and the lower seal ring surface 96.

The seal ring 24 may be secured to the body 22 by locking the seal ring 24 to the body 22 with the locking mechanism 68, thereby keeping the gasket 28 compressed and achieving the tight seal between the body 22 and the seal ring 24. More specifically, after the seal ring 24 is properly aligned with the body 22 and the first gasket 28 is at least partially compressed, a continued axial force may be placed onto the seal ring 24 toward the body 22 until the second part 68*b* of the locking mechanism 68 engages with the first part 68*a* of the locking mechanism 68. Upon compression of the first gasket 28, the lower end of the seal ring skirt 98 and the locking flange 66 may be located under the lower end of the side portion 64 of the body flange 52 or the first part 68*a* of the locking mechanism 68. The locking flange 66 and/or the second part 68*b* of the locking mechanism 68 may have a tendency, due to the resilient and bendable nature of the material used in this embodiment, to snap below the lower end of the side portion 64 of the body flange 52 or the first part 68*a* of the locking mechanism 68, thereby locking the seal ring 24 to the body 22.

Figure 12:
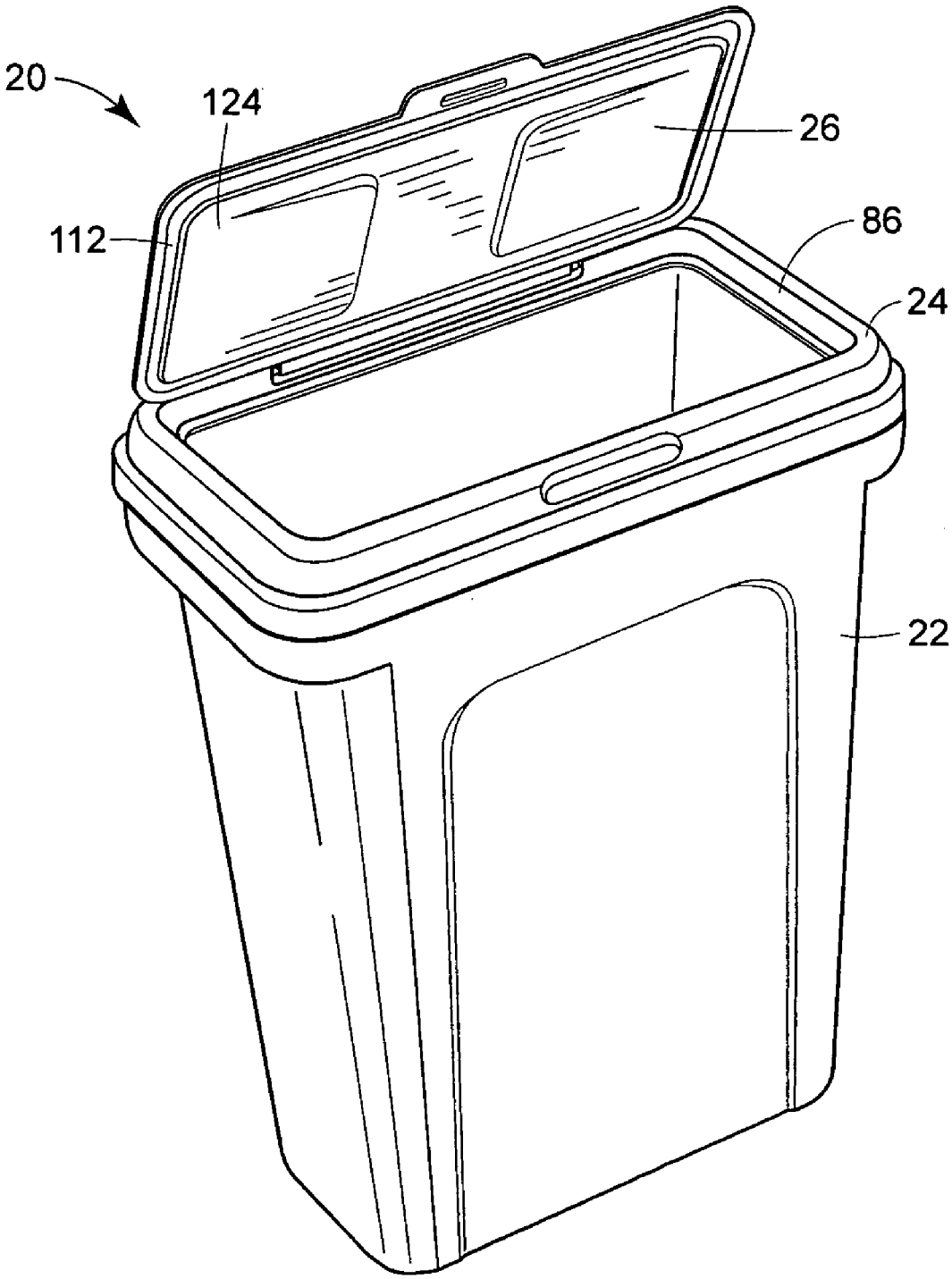
FIG. 12 is a perspective view of the container of FIG. 1 with the lid in an open position.
Figure 13:
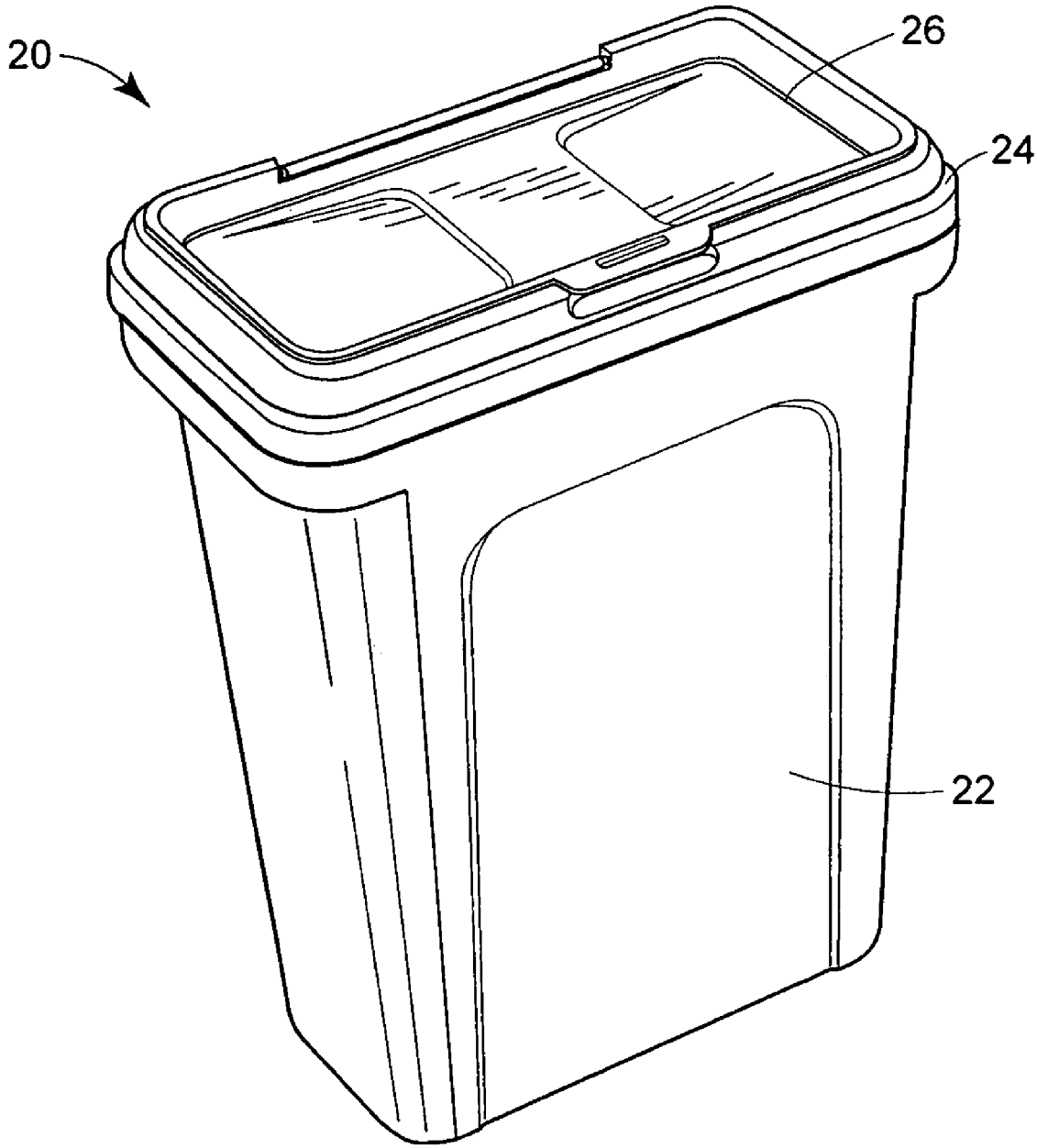
FIG. 13 is a perspective view of the container of FIG. 1 with the lid in a closed position.

As seen in FIGS. 1, 8, and 9, the lid 26 may be pivotally attached to the seal ring 24 by and at the pivot mechanism 100 and, more specifically, the lid 26 may be pivotally attached to the seal ring 24 by inserting the posts of the second locking portion 100*b* into the apertures of the first locking portion 100*a*. Once the lid 26 is pivotally attached to the seal ring 24, the container 20 may be in an open position, as seen in FIG. 12, and may be put in closed position by rotating the lid 26 downwardly, until the lid seal surface 124 abuts the seal ring 24, as seen in FIG. 13. More specifically, the lid 26 and seal ring 24 may be aligned in horizontal and vertical planes as the side wall 112 of the lid 26 enters the area defined by the inner wall 86 of the seal ring 24. In this example, the upper seal ring surface 92 and the lid seal surface 124 may be aligned and parallel to each other, the side wall 112 of the lid 26 and the inner wall 86 of the seal ring 24 may be aligned and parallel to each other, and the lid flange 114 of the lid 26 and the top wall 84 of the seal ring 24 may be aligned and parallel to each other (FIG. 7). A tight seal may the be achieved between the lid 26 and the seal ring 24 by compressing and securing the second gasket 30 between the lid seal surface 124 and the upper seal ring surface 92. The lid 26 may be secured to the seal ring 24 by engaging the first and second portions 102*a* and 102*b* of the latching mechanism 102.

Once the container 20 is closed and sealed, as seen in FIG. 13, the dog food stored in the container 20 will remain fresh. The food may also be easily accessible by opening the lid 26 in the seal ring 24. More specifically, the seal ring 24 is a piece of substantial size that may be difficult to remove and replace every time the user has to access the container 20. In separating the seal ring 24 and lid 26, the user need only lift or close the lid 26 of the container 20 to access or reseal the container 20.

Figure 14:
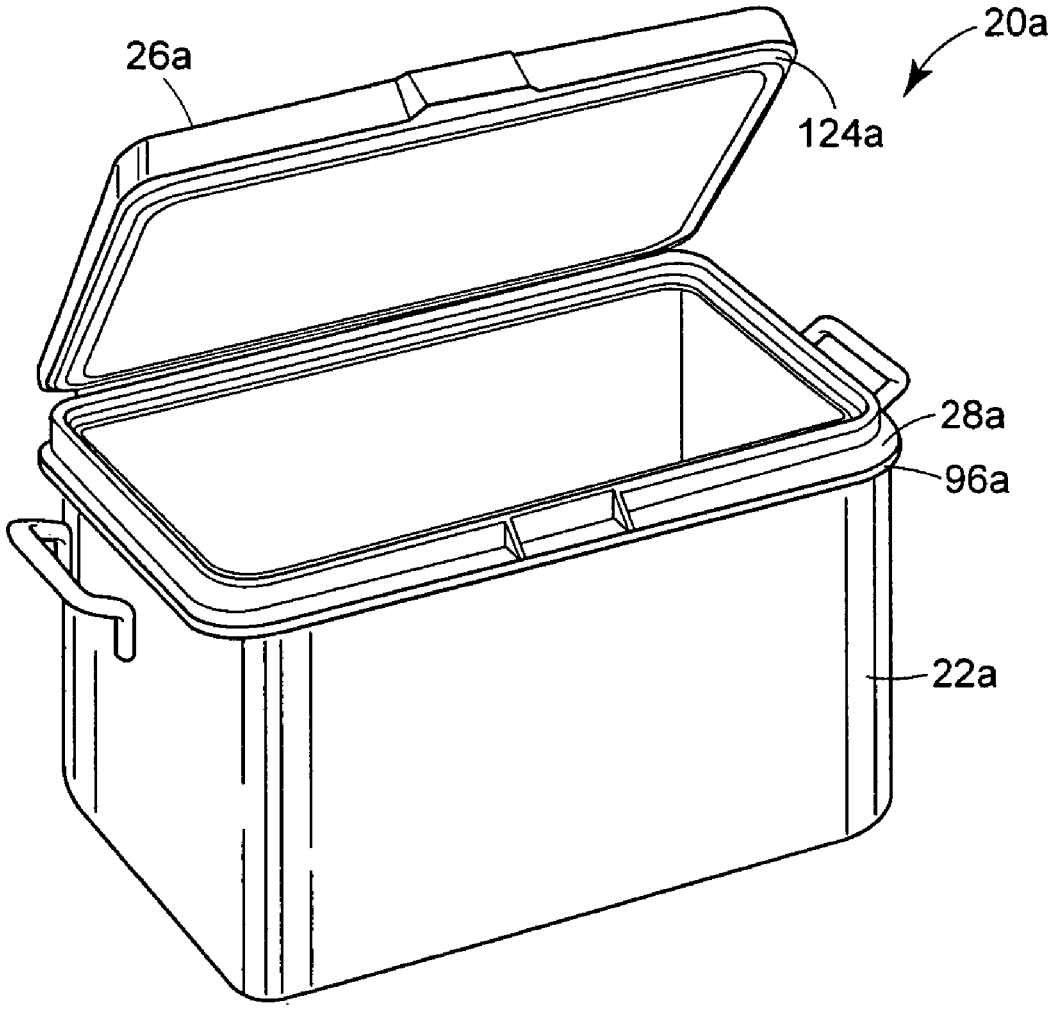
FIG. 14 is a perspective view of a cooler having a foam gasket constructed in accordance with the teachings of the present disclosure.

In another embodiment, as seen in FIG. 14, the container 20 may be a cooler 20*a*, including a lid 26*a* having a seal ring surface 96*a*, a body 22*a*, a lid seal surface 124*a*, and a gasket 28*a* therebetween. As such, the cooler 20*a* will have a tight seal when closed.

Figure 15:
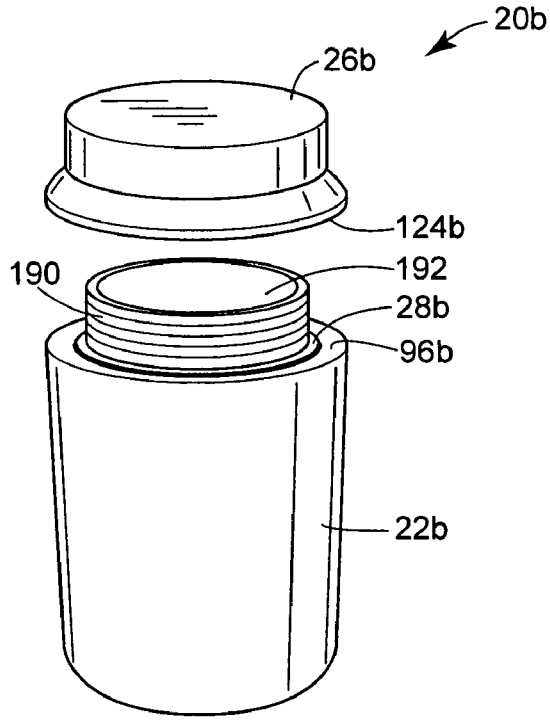
FIG. 15 is a perspective view of a drink cooler having a foam gasket constructed in accordance with the teachings of the present disclosure.

In yet another embodiment, as seen in FIG. 15, the container 20 may be a liquid cooler 20*b*, including a lid 26*b* having a lid seal surface 124*b*, a body 22*b*, a seal ring surfaces 96*b*, and a gasket 28*b* therebetween. The lid 26*b* includes an internally threaded surface adapted to engage with an externally threaded surface 190 located on a neck 192 of the body 22*b*. As such, as the lid 26*b* is threaded onto the neck 192 of the body 22*b* until the lid seal surface 124*b* abuts and at least partially compresses the gasket 28*b*, thereby creating a tight seal between the lid 26*b* and the body 22*b*.

Figure 16:
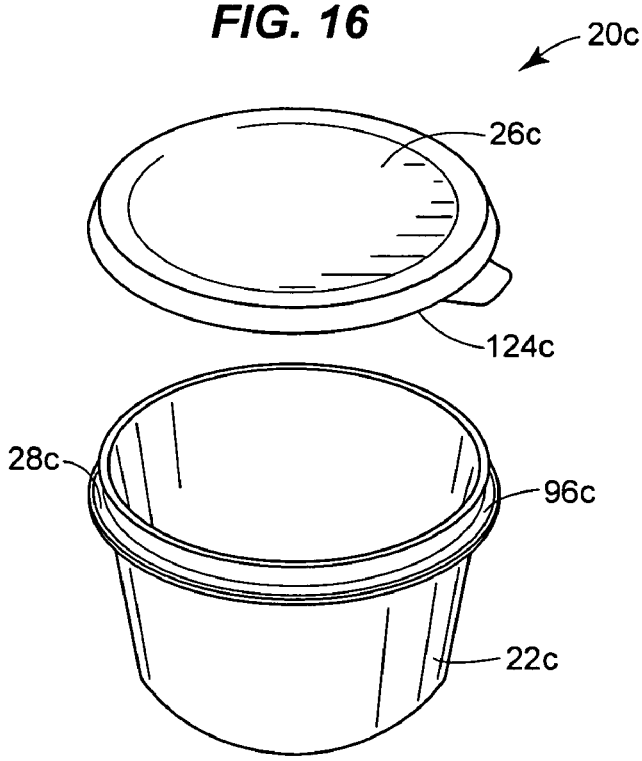
FIG. 16 is a perspective view of a food container having a foam gasket constructed in accordance with the teachings of the present disclosure.

In yet another embodiment, as seen in FIG. 16, the container 20 may be food storage container 20*c* used for storing left-overs or other food related items in a refrigerator, or the like. The food storage container 20*c* may including a lid 26*c* having lid seal surface 124*c*, a body 22*c*, a seal ring surfaces 96*c*, and a gasket 28*c* therebetween. As such, the food storage container 20*c* will have an air-tight seal when closed.

The foregoing detailed description has been given for clearness of understanding only and no unnecessary limitations should be understood therefrom, as modifications will be apparent to those skilled in the art.

What is claimed is:

1. A container having an openable lid comprising:

a body having a base and at least one wall extending upwardly from the base;

a guide ridge upwardly extending from the top of the at least one wall, and a body flange having an upper portion outwardly extending from a bottom of the guide ridge defining a body seal surface, and a side portion extending downwardly from an outer end of the upper portion;

a seal ring removably attached near the top of the at least one wall and having a top wall and a groove disposed below the top wall for receiving the guide ridge, and a lower seal flange connected to the top wall and positioned below the groove and extending outwardly and horizontally, a lower seal ring surface formed on the lower seal flange sized and positioned to overlie and seal against the upper portion of the body flange;

a seal ring skirt downwardly extending from the lower seal flange; and a locking flange inwardly extending from a bottom of the seal ring skirt, wherein the body flange engages the locking flange when the seal ring is attached to the body;

an upper seal ring surface disposed near a top of the seal ring;

a lid adapted to engage a top of the seal ring, thereby opening and closing the container, the lid comprising a lid seal surface disposed near a bottom of the lid, wherein the lid seal surface is sized and positioned to engage the upper seal ring surface;

a first foam gasket attached to and located on one of the body seal surface and the lower seal ring surface; and a second foam gasket attached to and located on one of the upper seal ring surface and the lid seal surface, wherein the first foam gasket provides a seal between the body and the seal ring and the second foam gasket provides a seal between the seal ring and the lid when the container is in a closed position, the first foam gasket being attached to the one of the body seal surface and the lower seal ring surface while in fluid form and the second foam gasket being attached to the one of the upper seal ring surface and the lid seal surface while in fluid form.

2. The container of claim 1, wherein the lid is pivotally attached to the seal ring.

3. The container of claim 1, wherein the seal ring snaps onto the at least one wall body.

4. The container of claim 1, wherein at least one of the first foam gasket and the second foam gasket is located within a channel.

5. The container of claim 1, wherein the lid includes a locking mechanism.

6. The container of claim 1, wherein the locking flange further comprises a locking part adapted to further retain the lower portion of the body flange when the seal ring is attached to the body.

7. The container of claim 1, wherein the container is a cooler.

8. The container of claim 1, wherein the container is a food storage container.

9. The container of claim 1, wherein the container is a dog food container.

10. A container comprising:

a body having a base and a sidewall extending upwardly from the base;

a top portion of the sidewall including a guide ridge extending upwardly from the top portion of the sidewall, and a body flange having an upper portion outwardly extending from a bottom of the guide ridge defining a body seal surface, and a side portion extending downwardly from an outer end of the upper portion;

a lid pivotally attached to a seal ring, the lid sized to cover an opening defined by the seal ring;

the seal ring including a seal flange sized and positioned to be supported over the upper portion of the body flange, a guide groove defined by an inner wall, an outer wall and a top wall, said guide groove disposed above the seal flange and sized to fit over the guide ridge;

a seal ring skirt extending downwardly from an outer end of the seal flange;

a locking flange extending inwardly from a bottom portion of the seal ring skirt, the locking flange sized to snap over and engage the side portion of the body flange when the seal ring is attached to the body;

the seal ring including an upwardly facing upper seal surface positioned to support a portion of the lid when the lid is in a closed position;

a first foam gasket secured above the body seal surface; and a second foam gasket secured above the upper seal surface.

11. The container of claim 10, wherein the guide groove is disposed between the seal flange and the upper seal surface.

* * * * *

UNITED STATES PATENT AND TRADEMARK OFFICE

CERTIFICATE OF CORRECTION

PATENT NO. : 7,621,417 B2
APPLICATION NO. : 10/964261
DATED : November 24, 2009
INVENTOR(S) : Peterson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 944 days.

Signed and Sealed this

Twenty-sixth Day of October, 2010

David J. Kappos

David J. Kappos
*Director of the United States Patent and Trademark Office*